US006269988B1

(12) United States Patent
Kool

(10) Patent No.: US 6,269,988 B1
(45) Date of Patent: Aug. 7, 2001

(54) SHIRT COLLAR FORMER

(76) Inventor: Russell J. Kool, P.O. Box 1322, Cedar Rapids, IA (US) 52406

( * ) Notice: Subject to any disclaimer, the term of this patent is extended or adjusted under 35 U.S.C. 154(b) by 0 days.

(21) Appl. No.: 09/627,908

(22) Filed: Jul. 27, 2000

(51) Int. Cl.[7] ..... D06C 15/00
(52) U.S. Cl. ..... 223/52.1; 223/84; 223/83
(58) Field of Search ..... 223/52.1, 52.2, 223/52.3, 52.4, 52.5, 52.6, 83, 84, 85, 1

(56) References Cited

U.S. PATENT DOCUMENTS 1,968,283 * 7/1934 Chace, Jr. ..... 223/52.1
1,980,845 * 11/1934 Beattie ..... 223/52.1
2,972,437 * 2/1961 Davis et al. ..... 223/52.1

* cited by examiner

*Primary Examiner*—Bibhu Mohanty
(74) *Attorney, Agent, or Firm*—James C. Nemmers

(57) ABSTRACT

The present invention relates to an improved shirt collar former for use in laundry and dry cleaning applications. A tapered cone of suitable material, preferably a ceramic, contains a slot for holding shirt hangers. The cone is combined with a heat source for accelerating the drying of shirt collars which typically contain more layers of material than the balance of the shirt. The tapered cone may accommodate shirts with collar sizes in a broad range. The slot contains a wide base capable of storing a number of hangers so that the hangers are readily available for use. Hangers may be positioned to receive a shirt when the shirt is placed over the collar forming cone. The present invention allows the convenient and efficient storage of hangers, drying of collars, and removal of shirts.

13 Claims, 1 Drawing Sheet

SHIRT COLLAR FORMER

BACKGROUND OF THE INVENTION

Shirt collars are normally comprised of a triple layer of material. In the process of pressing shirts in professional dry cleaning or laundering operations, shirts are removed from a washer extractor after a final spin or extraction. Because the collar contains more layers of material than the rest of the shirt, when the damp shirt is pressed, the collar typically requires additional drying or curing. Therefore, the last stage in professionally finishing a shirt is to button the top button and slide the shirt over a collar forming device to facilitate the drying of the collar.

The prior art includes tapered-cone type collar forming devices that may accommodate a range of collar sizes. Two known tapered-cone type collar forming devices in the prior art cones made by Bishop Freeman and Forenta. The Bishop Freeman cone is a cast aluminum tapered cone having a slot through the top of the cone that extends downward into the cone. The slot allows a shirt hanger to sit upright on the base of the slot with the hanger's hook extension portion protruding beyond the top of the cone so that a user may grasp the hanger to remove the finished shirt. Because the hanger extension portion extends beyond the top of the cone, the tapered cone is relatively short, and it is therefore limited in the range of collar sizes that it may accommodate.

The Forenta cones are similar to the Bishop cones. Forenta model 5C3L illustrates a triple cone unit having longer tapered cones, but not having slots for holding hangers. Forenta model 5CFL illustrates a similar, slotless, single cone unit. In both of these models, a light bulb is used as a heat source within the cone to accelerate the drying of the collar. Forenta models 2SCH and 2SCF contain shorter cones, like the Bishop Freeman cones.

The present invention combines a longer cone with unique slot and cavity to allow access to a hanger resting within the cone, but not extending above the top of the cone. In addition it provides a hanger storage area within the cone. The combination of a longer tapered cone effective for a broad range of collar sizes with a hanger storage system adds to the efficient operation of a dry cleaning or laundering service. By eliminating steps such as the individual loading of hangers, a combination system improves efficiency of the collar forming process.

None of the prior art cones teach a convenient method to store hangers within a cone and to facilitate the collar forming of wide range of shirt collar sizes through the use of a longer cone. There is, therefore, a need for a shirt collar former that supports the storage and use of hangers without limiting the height of the cone or the depth of a cone slot to the height of a hanger.

SUMMARY OF THE INVENTION

The present invention is an improvement upon collar forming cones. The cone of the present invention contains a vertical slot extending downwardly from the top of the cone. The base of the vertical slot is widened to accommodate the storage of a plurality of hangers that may hang upside down from their lateral bars until used. The depth of the slot may be greater than the height of a typical hanger because the cone is cut away near the cone top to provide a channel or cavity for accessing the hook of a hanger resting in the cone but not extending beyond the top of the cone. This new cone configuration may be combined with a heat source, such as an internal heat source like a light bulb. In addition, the cone is made of a ceramic material to prevent staining of shirt collars that could occur because of oxidation of a metal cone.

DESCRIPTION OF THE PREFERRED EMBODIMENT OF THE INVENTION

Figure 1:
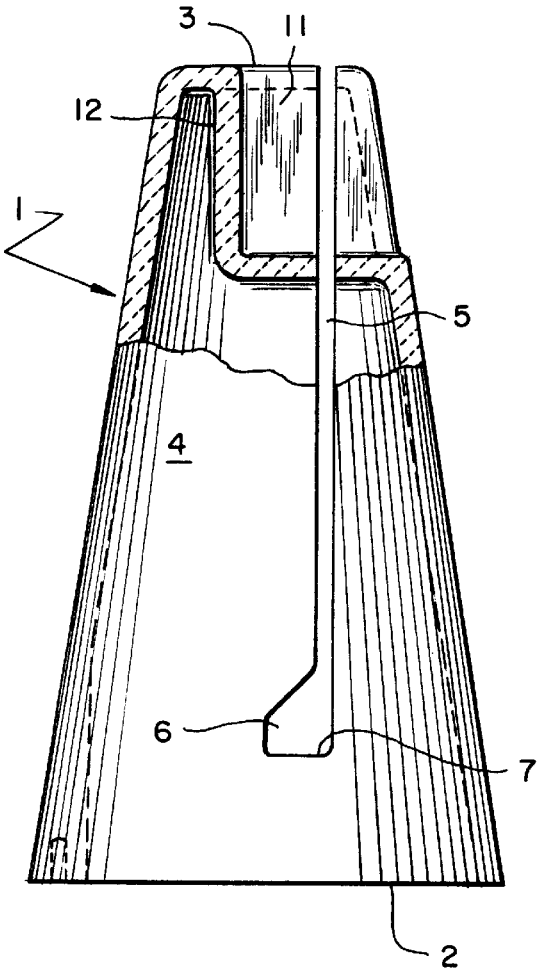
FIG. 1 is a side elevational view of a slotted, tapered cone having a widened slot base and a cut away hanger access cavity.

FIG. 1 illustrates the slotted, tapered cone 1 of the invention. The cone 1 has a generally conical body with a smooth outer surface 4 that joins a base 2 and a top 3. The height of the cone 1 is sufficient to accommodate shirt collars ranging in size from 13 to 22 inches. Of course, collars of greater or lesser width may also be accommodated based on slight changes from the dimensions of the presently preferred embodiment. In the presently preferred embodiment, the cone base 2 and top 3 have diameters of 7.5 and 3.5 inches, respectively. Given these diameters, a cone height of 13 inches provides the necessary taper to accommodate shirt collars in the range of 13 to 22 inches.

Figure 2:
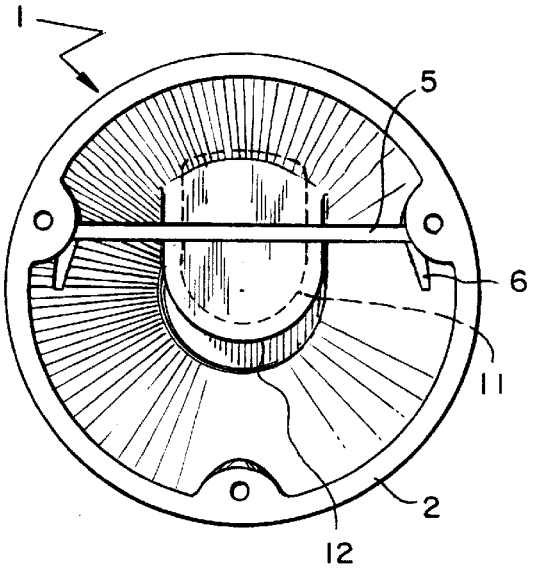
FIG. 2 is a bottom view of the slotted cone of FIG. 1.
Figure 3:
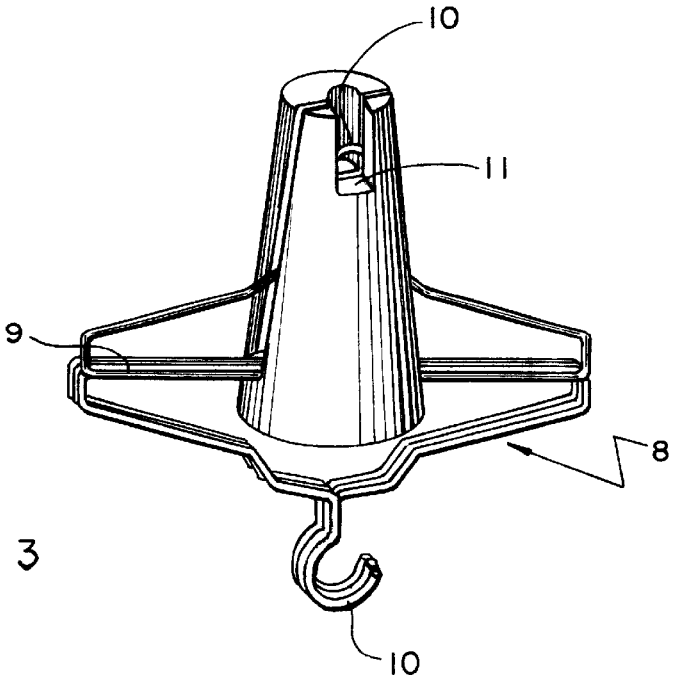
FIG. 3 is perspective view of a slotted, tapered cone having a cut-away, hanger access cavity.

In the presently preferred embodiment, a slot 5 extends downwardly from the cone top 3 through the outer surface 4. The slot 5 is located off center and has a wider opening 6 at the slot base 7. The wider opening 6 provides a hanger storage opening that may accommodate a convenient number of hangers 8 that hang upside down from their lateral base portions 9. When needed for hanging a shirt, a hanger 8 may be pulled upright so that its lateral base portion 9 rests upon the slot base 7 and its hook 10 is accessible through a hanger cavity 11 that extends through the outer surface 4 into the slot 5 near the top 3. FIG. 1 illustrates by dotted lines the cut-away hanger cavity 11, and FIG. 2 illustrates a bottom view of the same hanger cavity 11 in relation to the slot 5 and the tapered cone 1. The perspective view of FIG. 3 provides an illustration of a hanger hook 10 positioned for use and accessible through the hanger cavity 11. Although the hanger cavity 11 is functional in any of a variety of configurations, the preferred configuration of the cavity 11 has a rounded back 12 and smooth openings where it joins the outer surface 4 of the cone 1. Both the slot 5 and the hanger cavity 11 may or may not have interior walls. The cut-away hanger cavity 11 allows a shirt on a hanger 8 to be positioned lower on the cone 1 and the hanger to rest deeper in the cone 1 than possible with cones that require the hanger hook to protrude above the cone top. The convenient access to the hanger hook 10 through the cavity 11 allows easy and efficient removal of a shirt from the cone 1 and the efficient loading and storage of multiple hangers.

As is well know to those skilled in the art, the cone of the present invention is supported on a suitable stand (not shown) and also incorporates a heating element. The presently preferred heating element is a light bulb placed within the cone 1. Further, the cone of the invention preferably is made of a ceramic material, but may be made of any suitable material that does not readily oxide under moist conditions. A ceramic is preferred as a material because it avoids the discoloration of fabric through metal oxidation.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A shirt collar former for holding a hanger having a hook portion and an outwardly extending lateral portion for supporting a shirt with the shirt collar surrounding the former to facilitate drying of the collar, said shirt collar former comprising:

a tapered, generally conical body having an exterior surface with a top side and a bottom side, said top side having a diameter relatively smaller than the bottom side;

the outer surface having a slot formed therein extending across the body through the outer surface and extending from the top side downwardly through the body to a slot bottom edge located above the bottom side of the exterior wall;

the outer surface having a hanger storage opening formed therein at the slot bottom edge which storage opening is continuous with, and wider than, the slot formed in the outer surface;

the outer surface having a hanger access cavity formed therein extending generally into the body from the outer wall to the slot and extending generally downwardly from the outer wall top side to a height located at a distance above the slot bottom edge so that a hanger hook will be exposed in the hanger access cavity when a hanger lateral portion is resting on the slot bottom edge.

2. The shirt collar former of claim 1 further comprising:

a stand combined with the conical body to support the body at a height convenient for manual mounting and removal of shirts and hangers from the body.

3. The shirt collar former of claim 2 wherein:

the stand is adjustable in height.

4. The shirt collar former of claim 2 wherein:

a heating element is combined with and located within the body.

5. The shirt collar former of claim 4 wherein:

the heating element is a light bulb.

6. The shirt collar former of claim 1 further comprising:

a slot wall engaging the outer surface and extending through the body.

7. The shirt collar former of claim 1 further comprising:

a slot front wall combined with the outer surface and extending through the body;

a slot rear wall engaging the outer surface and extending through the body;

a hanger storage opening front wall combined with the outer surface and extending through the body;

a hanger storage opening rear wall combined with the outer surface and extending through the body; and a hanger storage opening bottom wall combined with the outer surface and extending through the body.

8. The shirt collar former of claim 1 further comprising:

a hanger access cavity wall combined with the outer surface and extending into the body.

9. The shirt collar former of claim 8 further comprising:

a hanger access cavity left wall combined with the outer surface and extending into the body;

a hanger access cavity right wall combined with the outer surface and extending into the body; and a hanger access cavity bottom wall combined with the outer surface and extending into the body.

10. The shirt collar former of claim 1 wherein:

the body is made of a ceramic material.

11. The shirt collar former of claim 1 wherein:

the bottom side diameter of the bottom side of the body is about 7.5 inches.

12. The shirt collar former of claim 1 wherein:

the diameter of the top side of the body is about 3.5 inches.

13. The shirt collar former of claim 1 wherein:

the outer surface of the body has a height of about 13 inches.

* * * * *